US007150228B2

(12) United States Patent
Scherge et al.

(10) Patent No.: US 7,150,228 B2
(45) Date of Patent: Dec. 19, 2006

(54) GAS PRESSURE SWITCH

(75) Inventors: Wolfgang Scherge, Hermannsburg (DE); Michael Schwenzer, Hermannsburg (DE); Werner Koch, Lilienthal (DE)

(73) Assignee: Rheinmetall W & M GmbH, Unterluss (DE)

( * ) Notice: Subject to any disclaimer, the term of this patent is extended or adjusted under 35 U.S.C. 154(b) by 303 days.

(21) Appl. No.: 10/829,278

(22) Filed: Apr. 22, 2004

(65) Prior Publication Data

US 2005/0188877 A1 Sep. 1, 2005

(30) Foreign Application Priority Data

Apr. 26, 2003 (DE) ..... 103 19 265
Nov. 19, 2003 (DE) ..... 103 54 012

(51) Int. Cl.
*F42C 15/40* (2006.01)

(52) U.S. Cl. ..... 102/263; 102/223

(58) Field of Classification Search ..... 102/262, 102/263, 222, 223
See application file for complete search history.

(56) References Cited

U.S. PATENT DOCUMENTS 2,458,478 A 1/1949 Maneval
2,674,946 A 4/1954 Hjelm
2,721,913 A 10/1955 Kent
2,873,681 A 2/1959 Lauritsen
2,931,874 A * 4/1960 Leaman ..... 337/406
3,155,800 A * 11/1964 Denton ..... 337/409
3,167,018 A 1/1965 Brunner
3,248,504 A 4/1966 McGirr et al.
3,275,770 A 9/1966 Kilmer et al.
3,500,279 A 3/1970 Malaspina
3,601,057 A * 8/1971 Kline ..... 102/263
3,675,579 A * 7/1972 Min ..... 102/229
3,698,323 A 10/1972 Apstein et al.
3,991,649 A * 11/1976 Patrichi ..... 89/1.14
4,150,266 A 4/1979 Patrichi
4,339,638 A * 7/1982 Lascelles et al. ..... 200/52 R
4,527,025 A 7/1985 Patrichi et al.
4,852,494 A * 8/1989 Williams ..... 102/263
5,131,328 A * 7/1992 Chan ..... 102/229
5,262,753 A 11/1993 Duplaix

FOREIGN PATENT DOCUMENTS

DE 27 55 322 6/1979
DE 689 04 827 7/1993

(Continued)

*Primary Examiner*—Michael J. Carone
*Assistant Examiner*—James S. Bergin
(74) *Attorney, Agent, or Firm*—Stuart I. Smith; Venable LLP

(57) ABSTRACT

A gas pressure switch is provided for an ignition and safety system for ammunition. The switch includes a housing; a piston actuator within the housing, the piston actuator being displaceable from an idle position to a contacting position by propellant gases of the ammunition during use; at least two contact pins that are attached immovably to the housing; a contacting device operatively associated with the piston actuator and located on a first side of the piston actuator, the first side being opposite a second side on which the propellant gases act during use, the contacting device connecting electrically to the contact pins when the piston actuator is in the contacting position; and a locking pin which holds the piston actuator in the idle position until a predetermined gas pressure is reached and which shears off when the predetermined gas pressure is reached, so that the piston actuator can be displaced into the contacting position.

19 Claims, 8 Drawing Sheets

FOREIGN PATENT DOCUMENTS

| | | | |
|---|---|---|---|
| FR | 79.714 | E | 1/1963 |
| FR | 1.417.132 | A | 11/1965 |
| FR | 2.070.544 | A | 9/1971 |

* cited by examiner

GAS PRESSURE SWITCH

CROSS REFERENCE TO RELATED APPLICATION

This application claims the priority of German Patent Applications DE 103 19 265.4 filed Apr. 26, 2003, and DE 103 54 012.1 filed Nov. 19, 2003, which are incorporated herein by reference.

BACKGROUND OF THE INVENTION

The invention relates to a gas pressure switch for an ignition and safety system for ammunition.

Ignition and safety systems for ammunition require two physically independent release mechanisms for activating ignition circuits. For a spin-stabilized projectile, for example, the firing acceleration and the projectile spin are often used. However, a spin-dependent activation mechanism cannot be used for smooth-bore ammunition, e.g. 120 mm HE [high explosive] ammunition.

SUMMARY OF THE INVENTION

The gas pressure generated during the firing of barrel weapon ammunition provides an additional variable which can be used for the defined ignition activation. Attempts to use known pressure gauges and/or pressure switches with smooth-bore ammunition were not satisfactory, owing to a relatively high temperature dependence of the switching pressure. It has furthermore turned out that known gas-pressure switches frequently do not remain in the closed position (contacting position) but open up again under the effect of the firing stress. Finally, tests conducted by the applicant have proven that the pressure springs frequently used with known gas-pressure switches are not sufficient for holding the switching elements in the contacting position.

It is an object of the invention to provide a pressure switch for an ignition and safety system for ammunition of the aforementioned type, which ensures a secure operation when it is used with smooth-bore ammunition, for example HE tank ammunition, and which also ensures that the required release of the safety for the ignition and safety system does not occur until a defined propellant charge pressure is reached.

The invention is essentially based on the idea of embodying the gas pressure switch as a module, which is designed as single use switching element. The switch preferably takes the form of a screw which can be screwed from the back and at an angle into the projectile tail section of the respective ammunition. The gas pressure switch comprises a piston actuator that can be displaced in the direction of the longitudinal axis of the switch and is secured in the idle position, by a locking pin arranged perpendicular to the longitudinal axis of the switch, against unintended displacement. This locking pin is designed and arranged such that the piston actuator cannot be damaged or moved during transport stresses, as well as during rough handling of the ammunition. On the side facing the loading chamber, the locking pin is preferably sealed in by a membrane of plastic material that is welded to the gas-pressure switch housing.

During the propellant charge combustion of the ignited ammunition, the membrane pushes against the head of the piston actuator. As soon as the gas pressure has reached a predetermined value, the locking pin shears off and the piston actuator is displaced axially to form a tight seat. During this displacement, the piston actuator connects two contacts with its lower end, which transmit a signal for actuating the ignition. The elastically deformable membrane additionally functions to keep the piston actuator in the contacting position, so that the contacts remain securely connected.

In contrast to known gas pressure switches, a functional separation between sealing and switching occurs for a switch according to the invention. As a result of the reshaping of the hat-shaped membrane, it remains in the "turned-up" condition and thus stops the piston actuator. In addition, no spring or other element is required for securing the switched state. It is therefore not necessary for the gas-pressure switch to contain plastic materials, sealing materials or adhesives, thus ensuring an extremely long shelf life and full operational reliability.

A gas-pressure switch according to the invention represents a crucial safety element for the ignition and safety system of a projectile. Prior to the single use switching operation, the gas-pressure switch remains securely electrically disconnected until a specified pressure is reached (e.g. 345 bar). The switching operation occurs only when a defined pressure is exceeded. Within approximately 15 milliseconds after being subjected to the required pressure, the switch is closed and remains securely in the closed position—without rebounding—until the explosive charge is ignited. Even following a storage of 15 years, the gas-pressure switch remains securely disconnected and meets all operational requirements.

Particular embodiments of the invention provide a gas pressure switch for an ignition and safety system for ammunition. The switch includes a housing; a piston actuator within the housing, the piston actuator being displaceable from an idle position to a contacting position by propellant gases of the ammunition during use; at least two contact pins that are attached immovably to the housing; a contacting device operatively associated with the piston actuator and located on a first side of the piston actuator, the first side being opposite a second side on which the propellant gases act during use, the contacting device connecting electrically to the contact pins when the piston actuator is in the contacting position; and a locking pin which holds the piston actuator in the idle position until a predetermined gas pressure is reached and which shears off when the predetermined gas pressure is reached, so that the piston actuator can be displaced into the contacting position.

BRIEF DESCRIPTION OF THE DRAWINGS

Further advantages and details of the invention follow from the exemplary embodiments and are explained in the following with the aid of the Figures, in which.

DETAILED DESCRIPTION OF THE INVENTION

Figure 1:
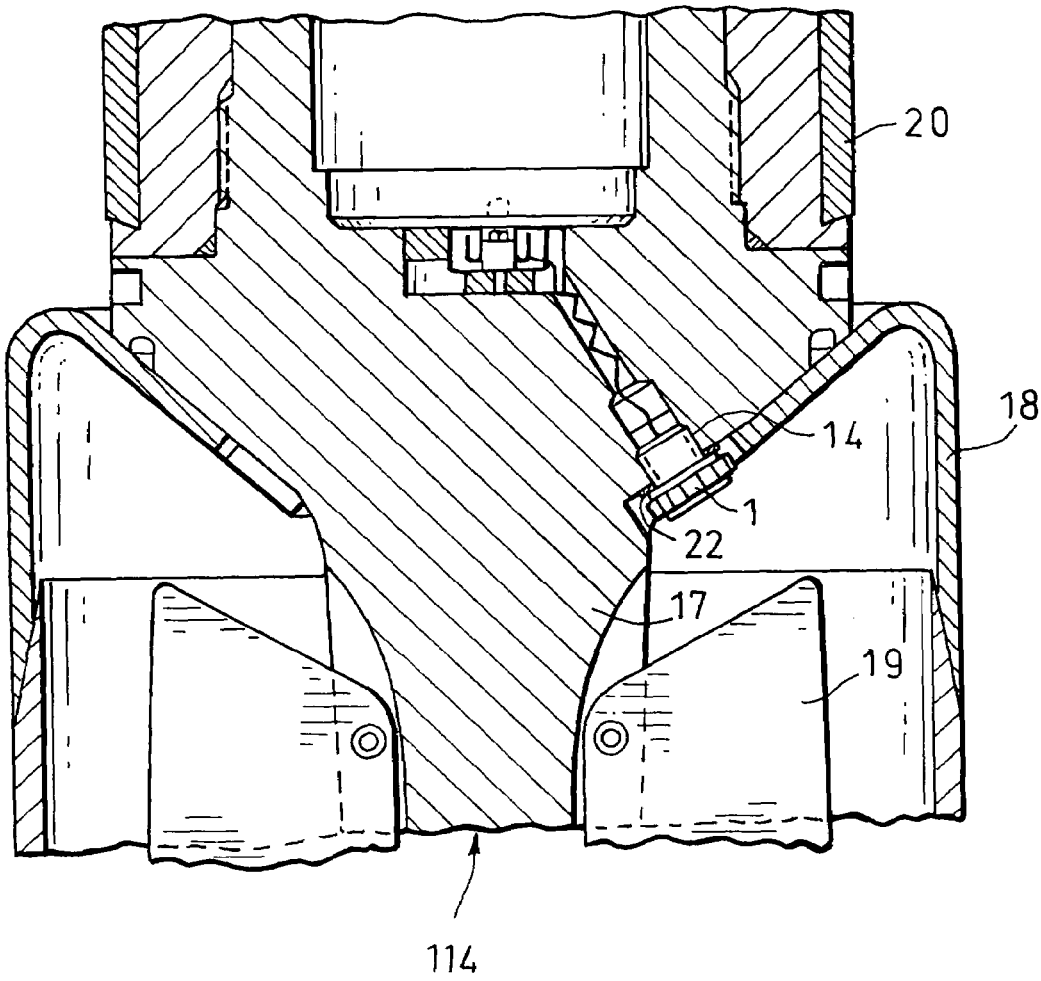
FIG. 1 shows an example of a positioning of a gas-pressure switch with piston actuator according to the invention in the tail section of an ammunition projectile.

FIG. 1 shows an example of the installation of an embodiment of the invention. FIG. 1 shows the installation of a gas-pressure switch 1 in the tail section of a smooth-bore projectile, preferably a HE projectile 114, wherein the gas pressure switch 1 takes the form of a hexagon head screw. The gas-pressure switch 1 with a thread 14 is screwed into a bore of the projectile tail section 17 and the screw receptacle is sealed with a sealing ring 22.

The propellant charge of the projectile 114 is located in a known manner inside a propellant charge case 18. Since the projectile shown here is a fin-stabilized projectile, guide fins 19 that can be unfolded are arranged at the projectile tail section 17.

The projectile 114, shown in FIG. 1, is guided inside a weapon barrel (not shown) with the aid of a driving band 20 that is attached to the projectile 114.

Figure 2:
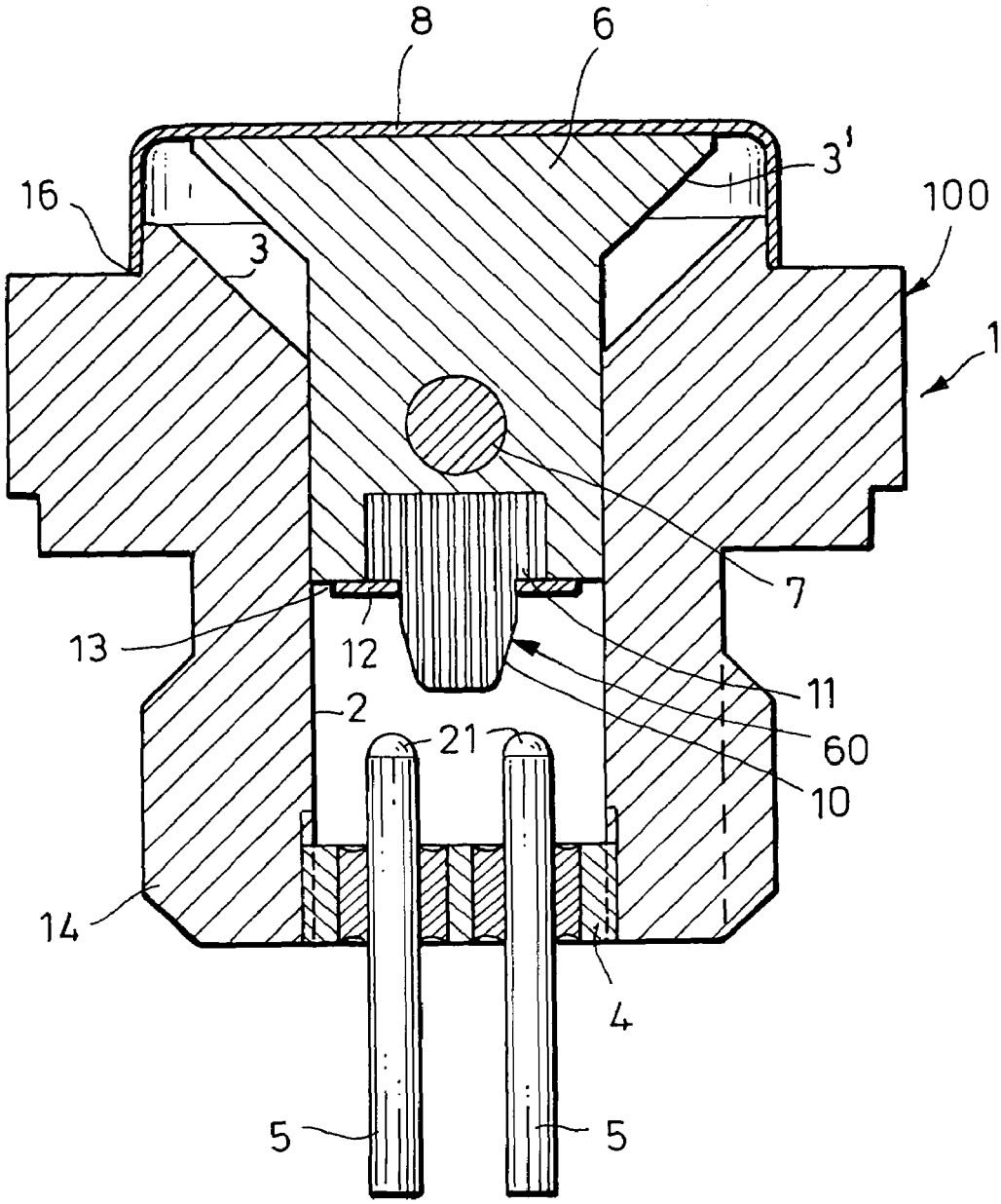
FIG. 2 shows a longitudinal section through a first exemplary embodiment of a gas-pressure switch according to the invention with the piston actuator shown in the idle position.
Figure 3:
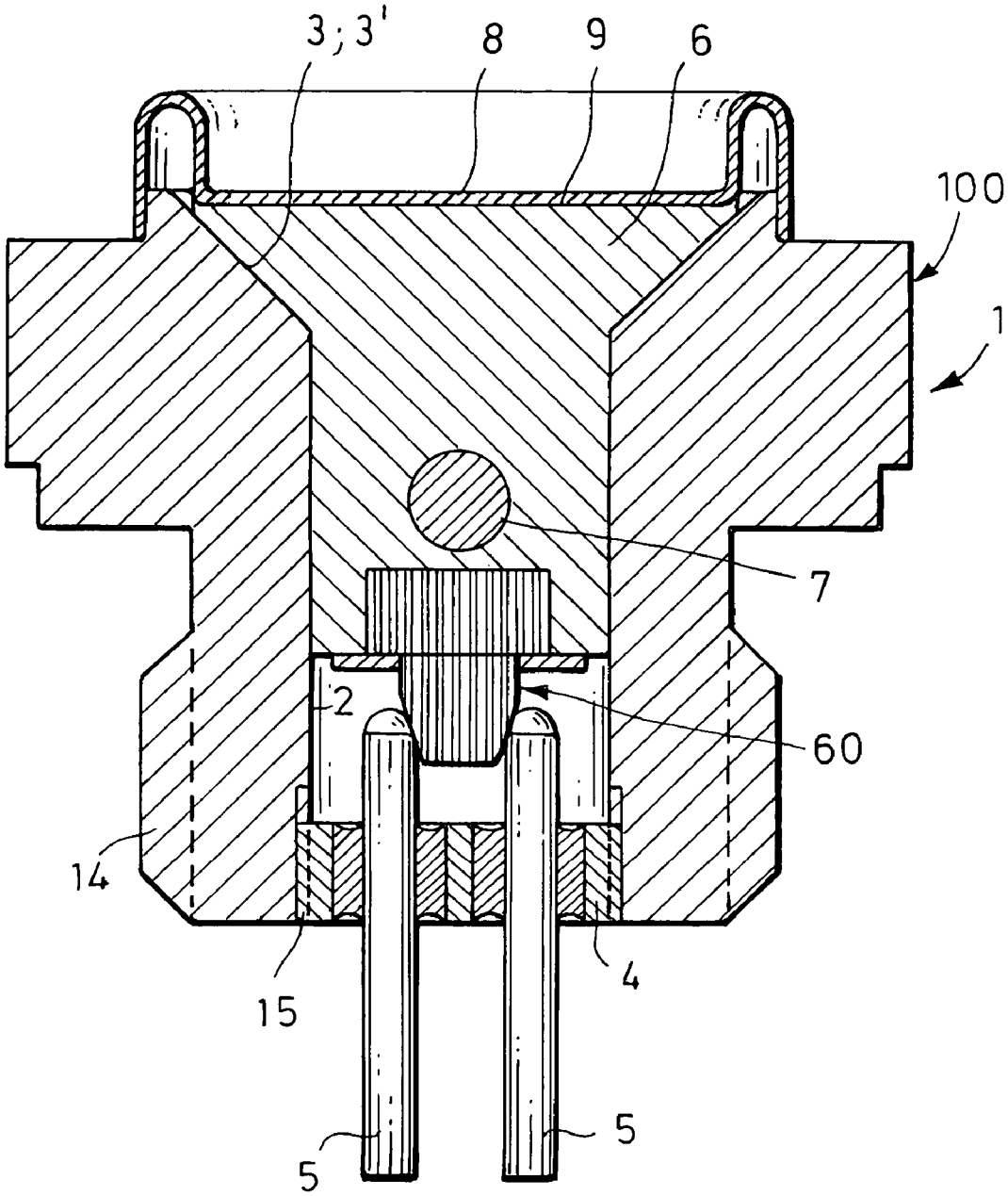
FIG. 3 shows the gas-pressure switch of FIG. 2 with the piston actuator shown in the contacting position.
Figure 4:
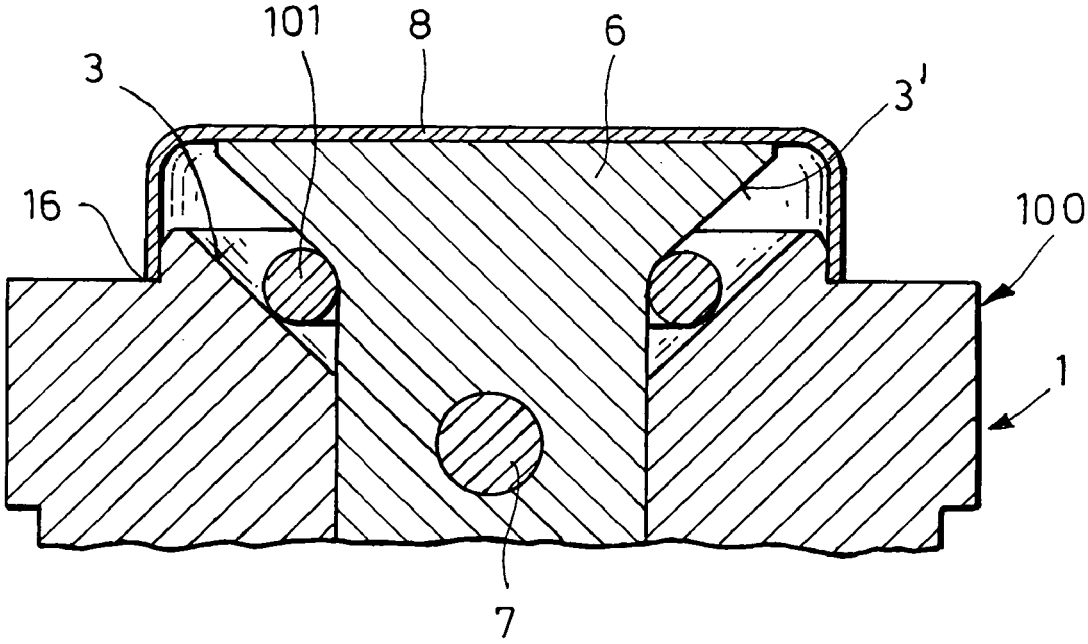
FIG. 4 shows a partial view of the gas-pressure switch of FIG. 2 with a damping element arranged between the piston actuator and the gas-pressure switch housing.

FIGS. 2 and 3 show an example of the gas-pressure switch 1 according to the invention. Gas-pressure switch 1 comprises a housing 100 that is, for example, made of stainless steel and is shaped like a hexagon head screw. A cylindrical bore 2 is arranged on the inside of the housing 100, which is provided with a cone-shaped depression 3 toward its upper end. A piston actuator 6 is guided inside the bore 2 and has a corresponding conical surface 3' in the region of the depression 3. Conical surface 3' and cone-shaped depression 3 form a tight seal between the housing 100 and the piston actuator 6. FIG. 4 shows that a ring-shaped damping element 101 of an elastic material (e.g. tin or lead) can additionally be arranged between the sealing surfaces 3 and 3'.

At the lower end of housing 100, a carrier 4 with insulated contact pins 5, preferably having gold plated tips 21, is located in the cylindrical bore 2. The carrier 4 is preferably screwed into the housing 100 and is welded on from the outside. The housing 100 for the gas-pressure switch 1 has external, extra fine threads 14 in its lower region. The gas-pressure switch 1 is screwed with the aid of the threads 14 into the projectile 114 and is sealed with the preferably metallic sealing ring 22 (FIG. 1).

The top of the piston actuator 6 is surrounded by a hat-shaped, elastically deformable membrane 8, which is welded to the switch housing 100. The piston actuator is connected at its lower end with a contacting device 60, in this example a pin-shaped element 11 having a ceramic insert with gold-plated contacting surfaces 10. The pin-shaped element 11, which is electrically insulated from the piston actuator 6, is attached in the region 13 with a holding ring 12 (e.g. welded with a laser) to the piston actuator 6.

The piston actuator in the idle position as shown in FIG. 2 is furthermore held in this position with a locking pin 7 that shears off.

The operating mode of the gas-pressure switch 1 according to the invention is discussed in further detail in the following. For this description, we assume that ammunition provided with the gas-pressure switch is located inside a, corresponding weapon and that the piston actuator 6 assumes the idle position shown in FIG. 2.

Once the ammunition is ignited, propellant gases form and the pressure inside the loading chamber of the weapon increases rapidly. As a result, the hat-shaped membrane 8 is pushed against the external frontal surface 9 of the piston actuator 6. With a defined pressure, the piston actuator 6 shears off the locking pin 7 at the shearing surfaces to the housing 100 and is then displaced in the axial direction to assume the tight seat (FIG. 3). The use of the damping element 101 (FIG. 4) in this case will prevent an excessively strong impact between the two sealing surfaces 3 and 3'.

During the displacement of the piston actuator 6, the pin-shaped element 11 of the contacting device 60 is pushed between the two contact pins 5, rigidly attached to the housing, and electrically connects the two contact pins, so that a signal is transmitted to the corresponding device (not shown herein) for activating the ignition.

The gold-plated contacting surfaces 10 of the ceramic insert 11 on the piston actuator 6 and the contact pins 5 ensure a trouble-free transmission of the signal.

Since the membrane 8 is elastically deformed by the gas pressure, it remains in the deformed state, so that the piston actuator 6 is secured form-fittingly in the lower, closed position (FIG. 3) and the gas-pressure switch 1 remains securely closed.

Tests have shown that the gas-pressure switch 1 according to the invention is gas-tight if it is subjected to pressures up to 6,500 bar for up to 15 milliseconds, wherein it has proven advantageous if the metal membrane 8 (along with the support 4 in region 15) is welded to the housing 100 in the region 16.

Figure 5:
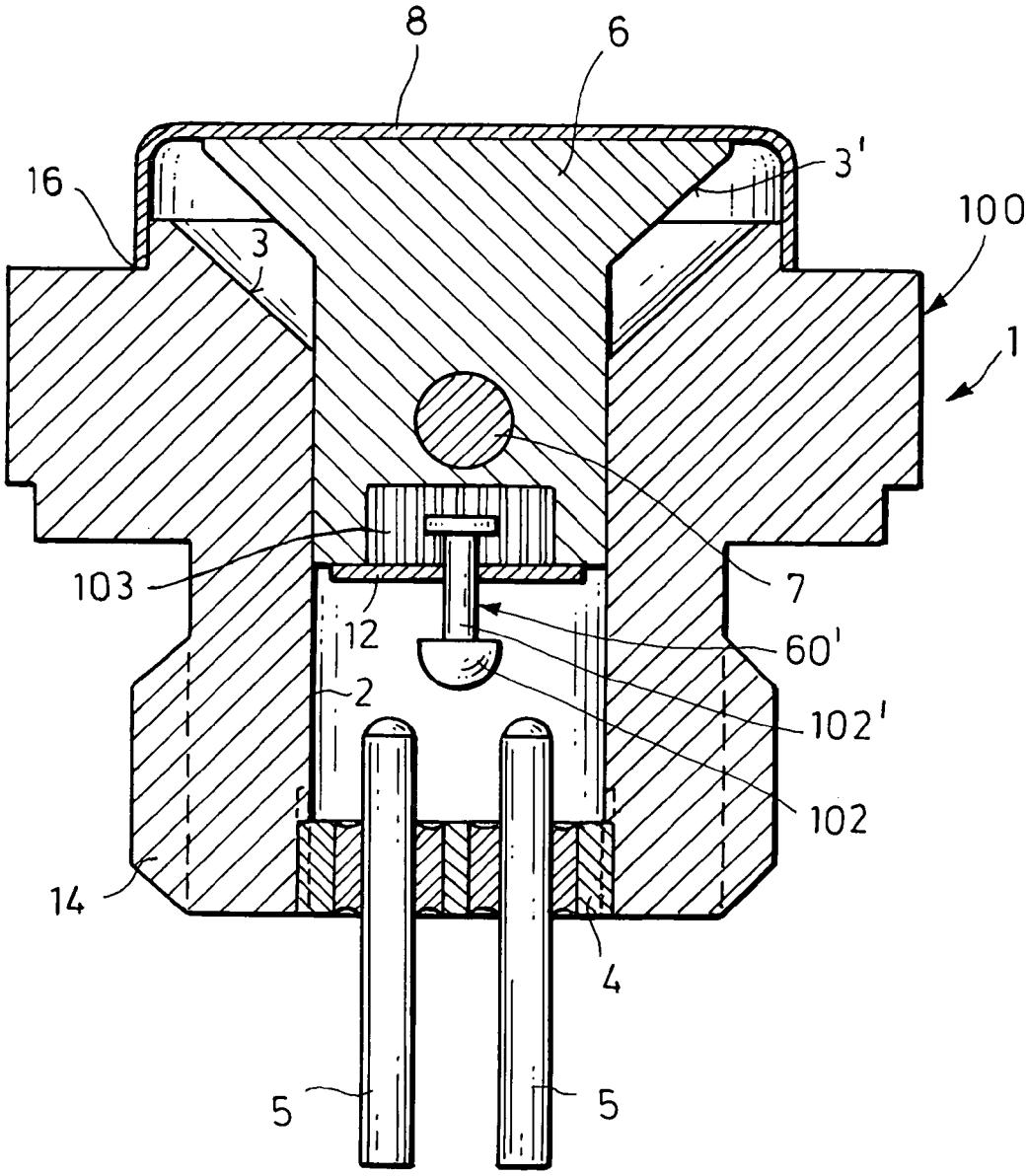
FIG. 5 shows a longitudinal section through a second exemplary embodiment of a gas-pressure switch according to the invention with the piston actuator shown in the idle position.
Figure 6:
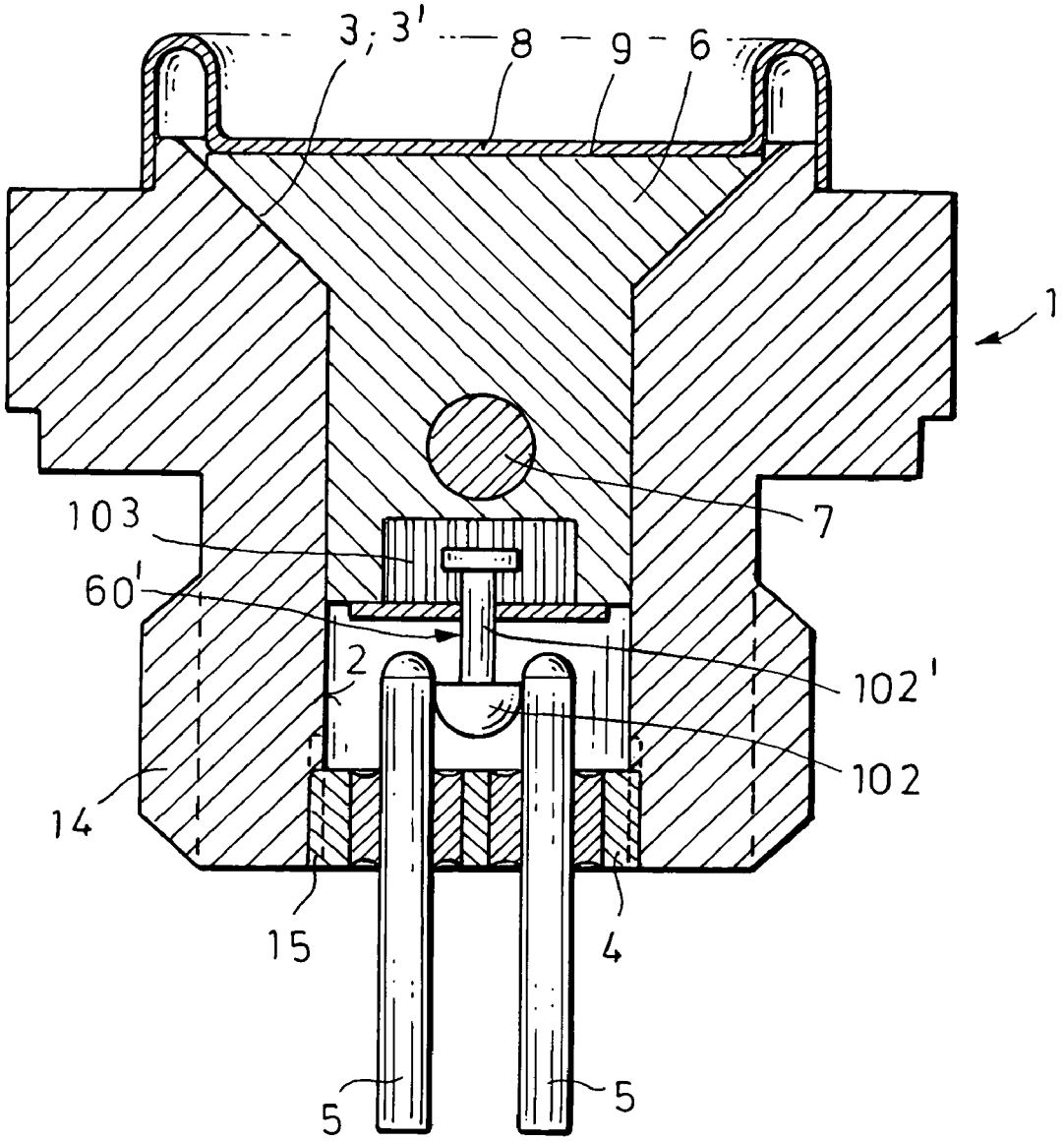
FIG. 6 shows the gas-pressure switch of FIG. 5 with the piston actuator shown in the contacting position.

FIGS. 5 and 6 show a second exemplary embodiment of a gas-pressure switch according to the invention. The example shown in FIGS. 5 and 6 differs from the one shown in FIGS. 2 and 3 in that the contacting device 60' is not a ceramic insert with metallized contacting surfaces, but is a metal actuating pin 102 that is connected to a plunger 102'. A holder 103 of an insulated material, preferably glass, holds the plunger 102' inside the piston actuator 6. The shape and diameter of the actuating pin 102 are selected such that the pin will "tightly grip" the contact pins 5 in the contacting position of piston actuator 6 (FIG. 6).

Figure 7:
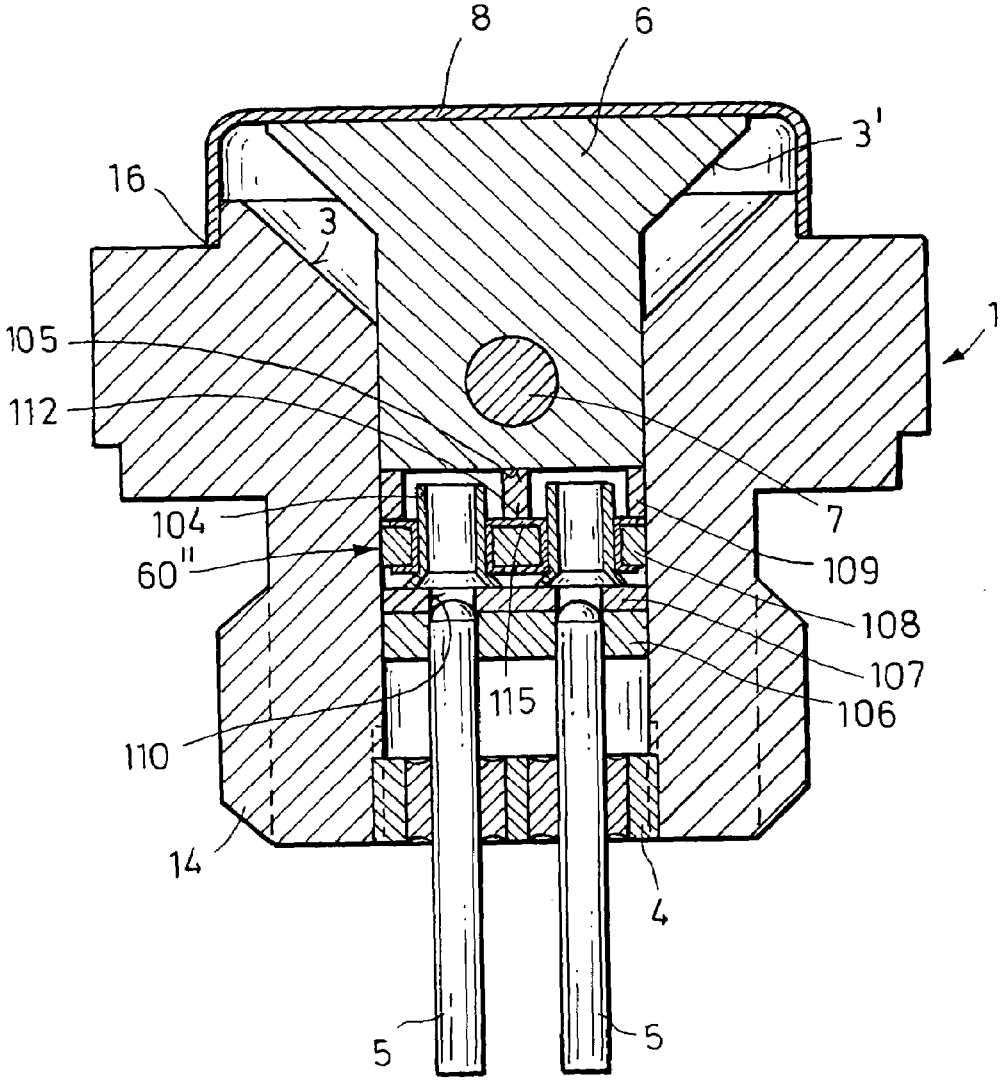
FIG. 7 shows a longitudinal section through a third exemplary embodiment of a gas-pressure switch according to the invention with the piston actuator shown in the idle position.
Figure 8:
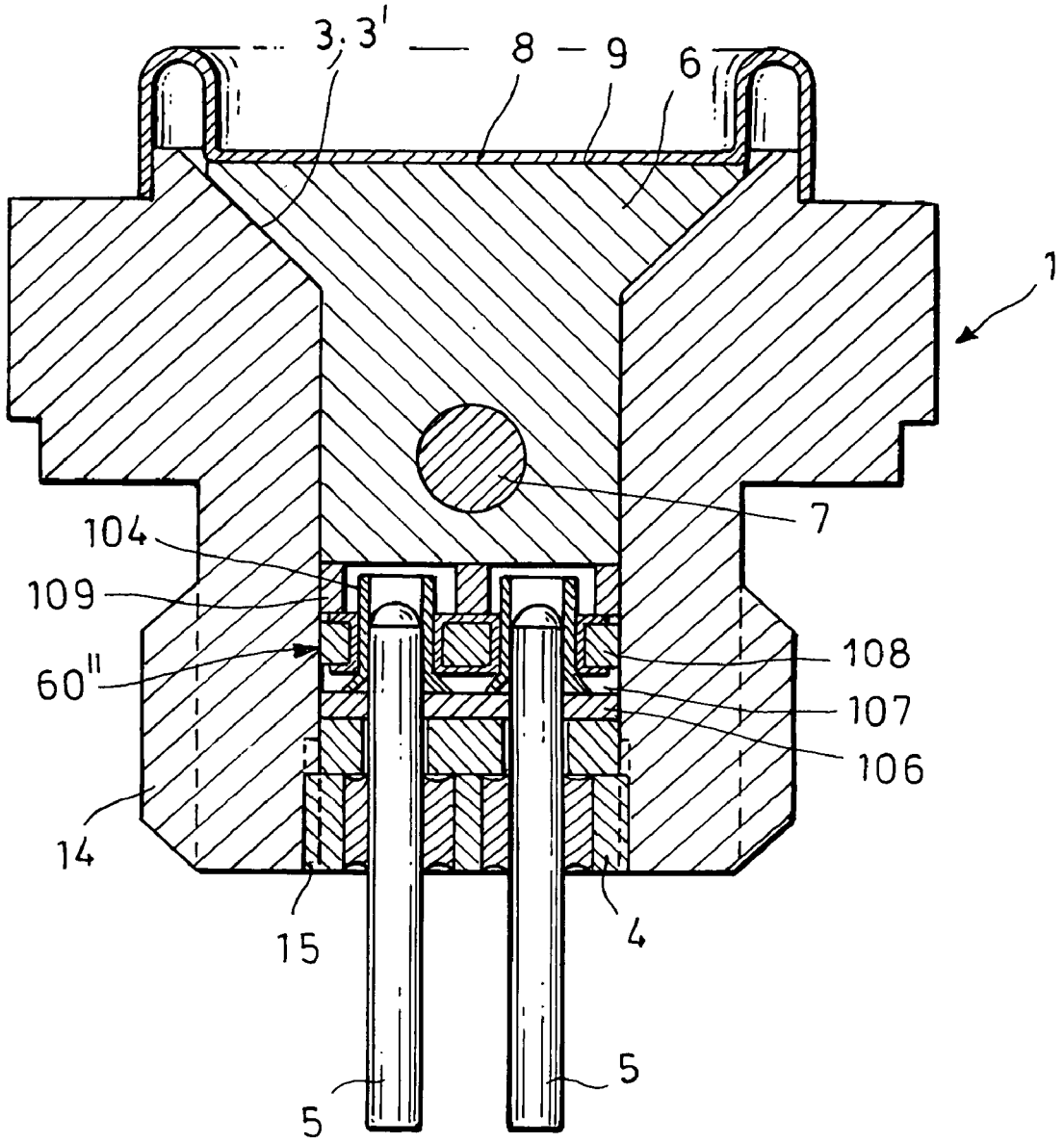
FIG. 8 shows the gas-pressure switch of FIG. 7 with the piston actuator shown in the contacting position.

An example of a third embodiment of the invention is shown in FIGS. 7 and 8. The difference between the gas-pressure switch shown in FIGS. 7 and 8 and the gas-pressure switch shown in FIGS. 2 and 3 is a contacting device with reference 60". This embodiment shows a separate component adjoining the underside of the piston actuator 6, wherein during the displacement of the piston actuator 6 from its idle position (FIG. 7) to its contacting position (FIG. 8) via the flat underside 105, the piston actuator 6 causes the contacting device 60" to be displaced.

The contacting device 60" has an arrangement of four elements, for example circuit boards 106–109, which adjoin in an axial direction. The first circuit board 106, which faces the contact pins 5 that are fixedly attached to the housing, is intended to center the contact pins 5.

The second circuit board 107 that adjoins, and is located above, the first circuit board 106 is provided with bores 110, which are arranged above the contact pins 5 and, in the idle position of piston actuator 6 (FIG. 7), have a smaller diameter as compared to the contact pins 5.

The second circuit board 107 is followed by a third circuit board 108 which is provided with two sleeve-shaped metal receptacles 104 that are connected electrically conducting via a copper coating 115. The position of the two receptacles 104 on the third circuit board 108 is therefore selected such that for the displacement of the piston actuator 6 from its idle position to its contacting position, each of the contact pins 5 that are rigidly attached to the housing is respectively pushed into one of the two sleeve-shaped receptacles 104.

The third circuit board 108 is followed at the top by a fourth circuit board 109, which fits against the front 105 of the piston actuator 6 and the front 112 of the third circuit board 108 to prevent any movement of the circuit board arrangement 60" when the piston actuator 6 (FIG. 7) is in the idle position.

When the gas-pressure switch is subjected to a defined gas pressure, the locking pin 7 is initially sheared off and the piston actuator 6 then pushes the complete circuit board arrangement 60" downward by pushing against the fourth circuit board 109. In the process, the contact pins 5 are pushed through the bores 110 of the second circuit board 107 and the sleeve-shaped receptacles 104 of the third circuit board 108 fit themselves over the contact pins 5, so that the gas-pressure switch is closed. Since the individual circuit boards 106–109 are insulated relative to the housing 100 of the gas-pressure switch, there is no electrical connection between the elements of the circuit board arrangement 60" and the housing 100.

The invention is not limited to the above-described exemplary embodiments. For example, the contacts attached to the housing can be attached either rigidly or elastically to the housing 100 for the gas-pressure switch.

It will be apparent, based on this disclosure, to one of ordinary skill in the art that many changes and modifications can be made to the invention without departing from the spirit and scope thereof.

What is claimed is:

1. A gas pressure switch for an ignition and safety system for ammunition, comprising:

a housing;

a piston actuator within the housing, the piston actuator being displaceable from an idle position to a contacting position by propellant gases of the ammunition during use;

at least two contact pins that are attached immovably to the housing;

a contacting device operatively associated with the piston actuator and located on a first side of the piston actuator, the first side being opposite a second side on which the propellant gases act during use, the contacting device connecting electrically to the contact pins when the piston actuator is in the contacting position; and a locking pin which holds the piston actuator in the idle position until a predetermined gas pressure is reached and which shears off when the predetermined gas pressure is reached, so that the piston actuator can be displaced into the contacting position.

2. The gas pressure switch according to claim 1, wherein the piston actuator is surrounded on its second side by an elastically deformable membrane that is connected to the housing and which pushes against the piston actuator once the predetermined gas pressure is reached and keeps the piston actuator in the contacting position once it reaches the contacting position.

3. The gas pressure switch according to claim 1, wherein the piston actuator and the housing of the gas pressure switch are provided with sealing surfaces which move toward each other when the piston actuator is moved from the idle position to the contacting position.

4. The gas pressure switch according to claim 3, wherein the sealing surfaces of the piston actuator and the housing are cone-shaped.

5. The gas pressure switch according to claim 3, further comprising a ring-shaped damping element of an elastic material arranged between the sealing surfaces of the piston actuator and the housing.

6. The gas pressure switch according to claim 5, wherein the damping element is made of tin or lead.

7. The gas pressure switch according to claim 1, wherein the contacting device comprises a pin-type element which is pushed between the contact pins to electrically connect the contact pins when the piston actuator is pushed from the idle position to the contacting position.

8. The gas pressure switch according to claim 7, wherein the pin-type element of the contacting device is a ceramic insert.

9. The gas pressure switch according to claim 8, wherein the pin-type element has contacting surfaces that are gold-plated.

10. The gas pressure switch according to claim 7, wherein the pin-type element is fixedly connected to the piston actuator.

11. The gas pressure switch according to claim 7, wherein the pin-type element of the contacting device is a metal actuating pin which is held in place either directly, or with the aid of a pin of electrically non-conducting material, by a holder that is arranged inside the piston actuator.

12. The gas pressure switch according to claim 11, wherein the holder for the actuating pin is glass.

13. The gas pressure switch according to claim 1, wherein the contacting device is an arrangement comprising at least two sleeve-shaped receptacles that are connected electrically to each other, such that each of contact pins is pushed into one of the sleeve-shaped receptacles when the piston actuator is moved from the idle position to the contacting position.

14. The gas pressure switch according to claim 13, wherein the contacting device is a circuit board arrangement.

15. The gas pressure switch according to claim 14, wherein the circuit board arrangement is a separate component that adjoins the piston actuator, and the piston actuator during its displacement via a flat underside of the piston actuator causes a corresponding displacement of the circuit board arrangement.

16. The gas pressure switch according to claim 14, wherein the circuit board arrangement comprises at least four axially adjoining circuit boards including a first circuit board which faces the contact pins and centers the contact pins;

a second circuit board provided with bores having a diameter smaller than a diameter of the contact pins to prevent the sleeve-shaped receptacles from making contact with the contact pins in the idle position of the piston actuator;

a third circuit board having the sleeve-shaped receptacles; and a fourth circuit board that rests against the piston actuator and the third circuit board, so as to prevent any movement of the circuit board arrangement while the piston actuator is in the idle position.

17. The gas pressure switch according to claim 1, wherein the contact pins are provided with gold-plated tips at contacting locations that contact the contacting device when the piston actuator is in the contacting position.

18. The gas pressure switch according to claim 1, wherein the contact pins are arranged so as to be insulated inside a carrier that is connected by threads to the housing and is welded to the housing so as to be gas-tight.

19. The gas pressure switch according to claim 1, wherein the gas pressure switch is for screwing into a tail end of the ammunition.

* * * * *